US007338148B2

(12) United States Patent
Ono

(10) Patent No.: US 7,338,148 B2
(45) Date of Patent: Mar. 4, 2008

(54) DROPLET EJECTING APPARATUSES AND METHODS FOR CLEANING DROPLET EJECTING FACE AND WIPING MEMBER

(75) Inventor: Yoshihiko Ono, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 140 days.

(21) Appl. No.: 11/252,612

(22) Filed: Oct. 19, 2005

(65) Prior Publication Data

US 2006/0274113 A1 Dec. 7, 2006

(30) Foreign Application Priority Data

Jun. 7, 2005 (JP) ..... 2005-166863
Jun. 22, 2005 (JP) ..... 2005-181638

(51) Int. Cl.
*B41J 2/135* (2006.01)

(52) U.S. Cl. ..... 347/45; 347/46; 347/47

(58) Field of Classification Search ..... 347/45–47, 347/64

See application file for complete search history.

(56) References Cited

U.S. PATENT DOCUMENTS 6,109,728 A * 8/2000 Kakuda et al. ..... 347/45
6,564,713 B2 * 5/2003 Suda et al. ..... 101/465

FOREIGN PATENT DOCUMENTS

| | | |
|---|---|---|
| JP | A 57-34969 | 2/1982 |
| JP | A 8-58096 | 3/1996 |
| JP | A 2000-974 | 1/2000 |
| JP | A 2004-114619 | 4/2004 |

* cited by examiner

*Primary Examiner*—Thinh Nguyen
(74) *Attorney, Agent, or Firm*—Oliff & Berridge, PLC

(57) ABSTRACT

A droplet ejecting apparatus comprising a droplet ejecting unit having a droplet ejecting face, wherein the droplet ejecting face is provided with nozzles which eject droplets containing an organic compound, the droplet ejecting apparatus ejects the droplets by an inkjet method, the droplet ejecting apparatus comprises a water-shedding film provided on the droplet ejecting face near the nozzles and a hydrophilic film containing a photocatalyst provided in a region on the droplet ejecting face other than near the nozzles. Also provided is a droplet ejecting apparatus comprising a droplet ejecting unit, a cleaning member, and a wiping member, wherein the cleaning member removes the dirt containing an organic compound adhered to the droplet ejecting face, the wiping member wipes off the dirt containing the organic compound adhered to the cleaning member, and a wiping part of the wiping member comprises a photocatalyst.

12 Claims, 9 Drawing Sheets

DROPLET EJECTING APPARATUSES AND METHODS FOR CLEANING DROPLET EJECTING FACE AND WIPING MEMBER

CROSS-REFERENCE TO RELATED APPLICATION

This application claims priority under 35 USC 119 from Japanese patent Application Nos. 2005-166863 and 2005-181638, the disclosures of which are incorporated by reference herein.

BACKGROUND OF THE INVENTION

1. Field of the Invention

The present invention is related to droplet ejecting apparatuses which conduct recording by ejecting droplets from droplet ejecting units to recording media, methods for cleaning droplet ejecting faces, and methods for cleaning wiping members mounted on droplet ejecting apparatuses.

2. Description of the Related Art

Droplet ejecting apparatuses which eject liquid ink from ejection openings, in particular inkjet recording apparatuses, have been uses as engines for many image forming systems recently because they are compact and inexpensive. Recording heads using piezoelectric systems (piezo-inkjet systems) are often used in inkjet printers because of their capability of forming high-definition image with high printing speed. In the piezoelectric systems, ink is ejected by driving piezoelectric elements through deformation thereof.

The PWA (Partial Width Array) system and FWA (Full Width Array) system are examples of the printing method (scanning method). In the PWA system, the recording head is moved in the direction (main scanning direction) which is orthogonal to the moving direction of the recording sheet while the recording sheet is moved at a predetermined pitch (sub scanning). In the FWA system, the recording head (full-line head) has a width which covers the entire width of the recording sheet (in the main scanning direction) and is fixed, and the recording sheet is moved in the sub scanning direction. In particular, the FWA system realizes a higher printing speed than the PWA system.

Inks containing pigments as colorants have conventionally been used for inkjet recording apparatuses having inkjet recording heads which conduct recording on recording sheets (recording media) by the ejection of ink droplets from nozzles. The use of pigments aims at the improvement of water resistance, light fastness, and the like. However, pigments themselves do not strongly adhere to the recording sheets. In order to improve the fixability on the recording sheets, inks further containing resins have been proposed.

However, ink leaks from the nozzles and also bounces back from the recording sheet during printing. As a result, ink adheres to near the nozzles and the resin as a solid component deposits thereon by drying. The deposition of the resin makes the ink meniscus instable, thus degrading the directivity of the ink droplets.

Towards the problem, a method has been proposed (for example in Japanese Patent Application Laid-Open (JP-A) No. 8-58096, the disclosure of which is incorporated herein by reference) in which a water-shedding film or a hydrophilic film is formed on the droplet ejecting face provided with the nozzles. However, even when this method is used, resin deposition occurs near the nozzles, the ejection of ink is impaired, and the directivity of the ink ejection is deteriorated during long-term use.

In order to make the nozzles on the droplet ejecting face conduct self-cleaning, there have been suggestions to provide a hydrophilic layer made of titanium oxide on the nozzle sheet (top plate), thereby decomposing ink dirt through photocatalytic reaction (see, for example, JP-A No. 2004-114619, the disclosure of which is incorporated herein by reference). However, when hydrophilicity is imparted to near the nozzles such as the nozzle sheet, ink leaks more easily to destabilize the formation of ink meniscus which largely affects the ejection of ink droplets. Particularly when the head structure adopts droplet modulation using the control of ink meniscus by a piezoelectric element or the like, the stability of the ejection is adversely affected.

Further, when the droplet ejection quantity is large, such as in the case of a printer equipped with the full-line head having plural ejection openings along the entire width of the recording region or in the case of high-speed printing in large quantity, the effect brought about by the technique is insufficient. Therefore, the problems concerning ink dirt have not been solved.

There are inks for inkjet recording which contain pigments. Inks containing pigments are advantageous in their high water resistance and light fastness and in capability of forming an image with high optical density. However, the inks are disadvantageous in the fixability of the image and the resistance to rubbing. In order to solve the problems, inks further containing resins are used.

When such an ink are used, the ink leaks from the nozzles and also bounces back from the recording sheet during printing to adhere to near the nozzles. As a result, the resin contained in the ink dries to deposit on near the nozzles. The deposition of the ink destabilize ink meniscus and deteriorates the directivity of the ejection of ink droplets.

A method for removing the dirt (such as dried resin) adhered to near the nozzles has been used in which the nozzle surface is cleaned by periodical wiping with a blade such as elastomer (see, for example, JP-A No. 57-34969, the disclosure of which is incorporated herein by reference). However, when this method is used, the resin deposits also on the blade during long-term use. As a result, the cleaning performance of the blade is deteriorated, so that the blade is no longer able to completely remove the resin or the like deposited on near the nozzles. Therefore, the directivity of the ejection of ink droplets is deteriorated.

Toward this problem, a method has been proposed, for example in JP-A No. 2000-000974, the disclosure of which is incorporated herein by reference. In this method, the dirt adhered to the blade is taken up by a suction device to clean the blade. However, sucked dirt accumulates in the sucking device in long-term use, whereby the suction efficiency of the suction device is lowered. Therefore, the dirt adhered to the blade cannot be completely removed by this method, either.

SUMMARY OF THE INVENTION

The present invention has been made in consideration of the above problems of the conventional techniques.

The invention provides a droplet ejecting apparatus comprising a droplet ejecting unit. The droplet ejecting unit has a droplet ejecting face provided with nozzles which eject droplets containing an organic compound. The droplet ejecting apparatus ejects the droplets by the inkjet method. The droplet ejecting apparatus comprises a water-shedding film provided on the droplet ejecting face near the nozzles and a hydrophilic film containing a photocatalyst in a region on the droplet ejecting face other than near the nozzles.

The photocatalyst may be titanium oxide. The droplet ejecting apparatus may further comprise an ultraviolet irradiation unit which irradiates the droplet ejecting face with ultraviolet rays.

When the droplet ejecting apparatus is operated and droplets containing a resin are ejected, the adhesion of the ink to near the nozzle is prevented owing to the presence of the water-shedding film and dirt accumulates the hydrophilic film provided around the water-shedding film. The dirt is decomposed upon irradiation with light owing to the action of the photocatalyst contained in the hydrophilic film. Therefore, the dirt does not remain on the hydrophilic film or is easily removable by wiping or the like. Since dirt does not deposit on the droplet ejecting face even when ejection is conducted for a long time, stable ejection can be achieved and the lifetime of the droplet ejection unit is elongated.

The photocatalyst is preferably titanium oxide, which has high catalytic effect on photodecomposition.

In the droplet ejecting apparatus, the ejection of droplets from the nozzles may be conducted by the displacement of a piezoelectric element.

Upon the ejection of droplets from the nozzles, the ejection of droplets is more strongly affected by the dirt in the piezo system than in the thermal system. This is because: the ejection quantity is relatively small and the droplet size is controlled by the meniscus amplitude on the droplet surface in the piezo system while the ejection quantity is relatively large and the volume change of the droplets is large in the thermal system. Accordingly, the structure of the droplet ejecting face of the invention is more effective in the system in which the ejection of droplets is conducted by the displacement of a piezoelectric element.

The droplet ejecting unit may have nozzles along the entire width of the region to be recorded. The droplets may be droplets containing a resin. The droplet ejecting unit may be a recording head which ejects droplets of a recording liquid containing an organic compound from nozzles upon application of a driving signal based on image data, and which records an image on a recording medium by the ejection of the droplets from the droplet ejecting face of the recording head.

The recording head may have nozzles along the entire width of the region to be recorded.

As described above, the FWA system has started to be used in inkjet recording from the viewpoint of high-speed printing. However, the total ejection quantity of recording liquids such as ink in the FWA system is larger than in conventional systems, whereby a larger quantity of dirt adheres to the recording head during ejection. In the FWA system, each of the nozzles of the long recording head does not always eject ink, and there are nozzles which do not eject ink for a longer time than in the PWA system. Around such nozzles, the dirt adhered to near the nozzles which cannot be removed by wiping cannot be removed by ink ejection, whereby the recording head structure of the invention is very effective.

The droplets may be droplets of a recording liquid containing a resin. As described above, the invention can be applied preferably to inkjet recording apparatuses which eject droplets of a recording liquid, and the invention is effective when ink droplets containing a resin are ejected.

The invention further provides a method for cleaning the droplet ejecting face of the droplet ejecting unit. The droplet ejecting face is provided with nozzles which eject droplets containing an organic compound. The method comprises providing a water-shedding film near the nozzles on the droplet ejecting face, providing a hydrophilic film containing a photocatalyst at a region on the droplet ejecting face other than near the nozzles, and irradiating the droplet ejecting face with ultraviolet rays to remove dirt adhered to the droplet ejecting face.

The invention further provides a droplet ejecting apparatus comprising a droplet ejecting unit, a cleaning member, and a wiping member. The droplet ejecting unit has a droplet ejecting face from which droplets containing an organic compound is ejected. The cleaning member removes the dirt containing an organic compound adhered to the droplet ejecting face. The wiping member wipes off the dirt containing the organic compound adhered to the cleaning member. The wiping part of the wiping member comprises a photocatalyst.

In this droplet ejecting apparatus, the dirt adhered to the droplet ejecting face is removed by the cleaning member, and the dirt adhered to the cleaning member is wiped off by the wiping member, and then the dirt adhered to the wiping member is decomposed by the photocatalyst contained in the wiping member.

As described above, dirt is adhered to the wiping member, and the organic compound contained in the dirt is decomposed by the photocatalyst and released to the air, whereby dirt does not accumulate on the wiping part of the wiping member. Therefore, the wiping member maintains its ability to remove the dirt adhered to the cleaning member, and dirt does not accumulate on the cleaning member. Accordingly, the cleaning member maintains its ability to remove the dirt adhered to the droplet ejecting face, and the dirt is completely removed every time the cleaning member wipes the droplet ejecting face. As the result, the droplets which accumulate on the droplet ejecting face and which are ejected from the droplet ejecting unit are ejected with stable directivity.

The photocatalyst may be titanium oxide. Titanium oxide is able to oxidize or reduce a wide range of substances, thus being suitable for the decomposition of organic compounds. In addition, titanium oxide can be used for a long time because it does not have self-decomposition property. Further, complicated devices are not necessary since titanium oxide functions as a catalyst under natural light or fluorescent light.

The film thickness of titanium oxide may be 1 μm or larger. When the thickness of titanium oxide is 1 μm or larger, the photocatalytic activity is maintained even when the titanium oxide film is somewhat abraded by the contact with the cleaning member, whereby long-term use is possible.

The droplet ejecting apparatus may further comprise an ultraviolet irradiation member which irradiates the wiping member with ultraviolet rays. When such an ultraviolet irradiation member is provided, the photocatalyst contained in the wiping member is sufficiently activated by the irradiation of the wiping member with ultraviolet rays emitted from the ultraviolet irradiation member even when the wiping member is disposed in a position which is not exposed to a light source outside the droplet ejecting apparatus, such as an indoor fluorescent lamp or the sunlight.

The cleaning member may be disposed along the longitudinal direction of the droplet ejecting unit, and may be moved in the direction orthogonal to the longitudinal direction of the droplet ejecting unit.

When the cleaning member is disposed along the longitudinal direction of the droplet ejecting unit, the dirt adhered to the droplet ejecting face of the droplet ejecting unit is removed by moving the cleaning device in the direction orthogonal to the longitudinal direction of the droplet ejecting unit, and the moving distance of the cleaning member is shorter than in the case where the cleaning device has to be moved in the longitudinal direction of the droplet ejecting unit. Accordingly, the space for the movement of the cleaning member is unnecessary, and the droplet ejecting apparatus can be compact.

The wiping part of the wiping member and the droplet ejecting face may be on substantially the same plane when the dirt adhered to the droplet ejecting face is removed. If the wiping part of the wiping member and the droplet ejecting face are on the same plane upon the removal of the dirt adhered to the droplet ejecting face, the cleaning member has to be moved only horizontally, but not in the vertical direction, whereby the structure for moving the cleaning member can be simple.

The droplet ejecting unit may comprise a piezoelectric element which ejects the droplets. When the piezoelectric element is provided to make the droplet ejection quantity variable, the direction of the droplet ejection is easily affected by the dirt on the droplet ejecting face of the droplet ejecting unit. Therefore, the stabilization of the efficiency of the cleaning of the droplet ejecting face is particularly advantageous in droplet ejecting apparatuses comprising piezoelectric elements owing to the prevention of destabilization of the direction of the ejection of the droplets over time.

The droplets containing an organic compound may be droplets of a recording liquid. When droplets of the recording liquid containing an organic compound are ejected and dirt adheres to the droplet ejecting face of the droplet ejecting unit, the direction of the ejection of the recording liquid is maintained stable by the stable cleaning of the droplet ejecting face.

The recording liquid may comprise a resin. When the recording liquid containing the resin is used, dirt is likely to adhere to the droplet ejecting face of the droplet ejecting unit. The direction of the ejection of the recording liquid is maintained stable by the stable cleaning of the droplet ejecting face.

The invention further provides a method of cleaning a wiping member which wipes off dirt adhered to a cleaning member that removes dirt adhered to the droplet ejecting face of the droplet ejecting unit. The droplet ejecting unit ejects droplets containing an organic compound. The wiping member comprises a photocatalyst, and dirt adhered to the wiping member is decomposed by the photocatalyst.

The cleaning member removes dirt from the droplet ejecting face, and the dirt adhered to the cleaning member is in turn wiped off by the wiping member, and the dirt adhered to the wiping member is decomposed by the photocatalyst. Since the dirt is adhered to the wiping member and then the organic compound contained in the dirt is decomposed by the photocatalyst to be released in the air, dirt does not accumulate on the wiping member.

DESCRIPTION OF THE PRESENT INVENTION

The droplet ejecting apparatus of the first embodiment is used for various applications including inkjet recording apparatuses which eject droplets of recording liquids such as ink, droplet ejecting apparatuses used for direct circuit drawing method in which circuit patterns are formed directly on supports, droplet ejecting apparatuses for color filter production, and droplet ejecting apparatuses for optical element production which may be used, for example for plane emission luminescent elements.

In the following, an example (an inkjet recording apparatus) of the droplet ejecting apparatus according to the first embodiment is specifically described with reference to drawings. The inkjet recording apparatus is suitable for the use of the method of the invention for cleaning the droplet ejecting face; therefore, the method is described together with the inkjet recording apparatus.

Figure 1:
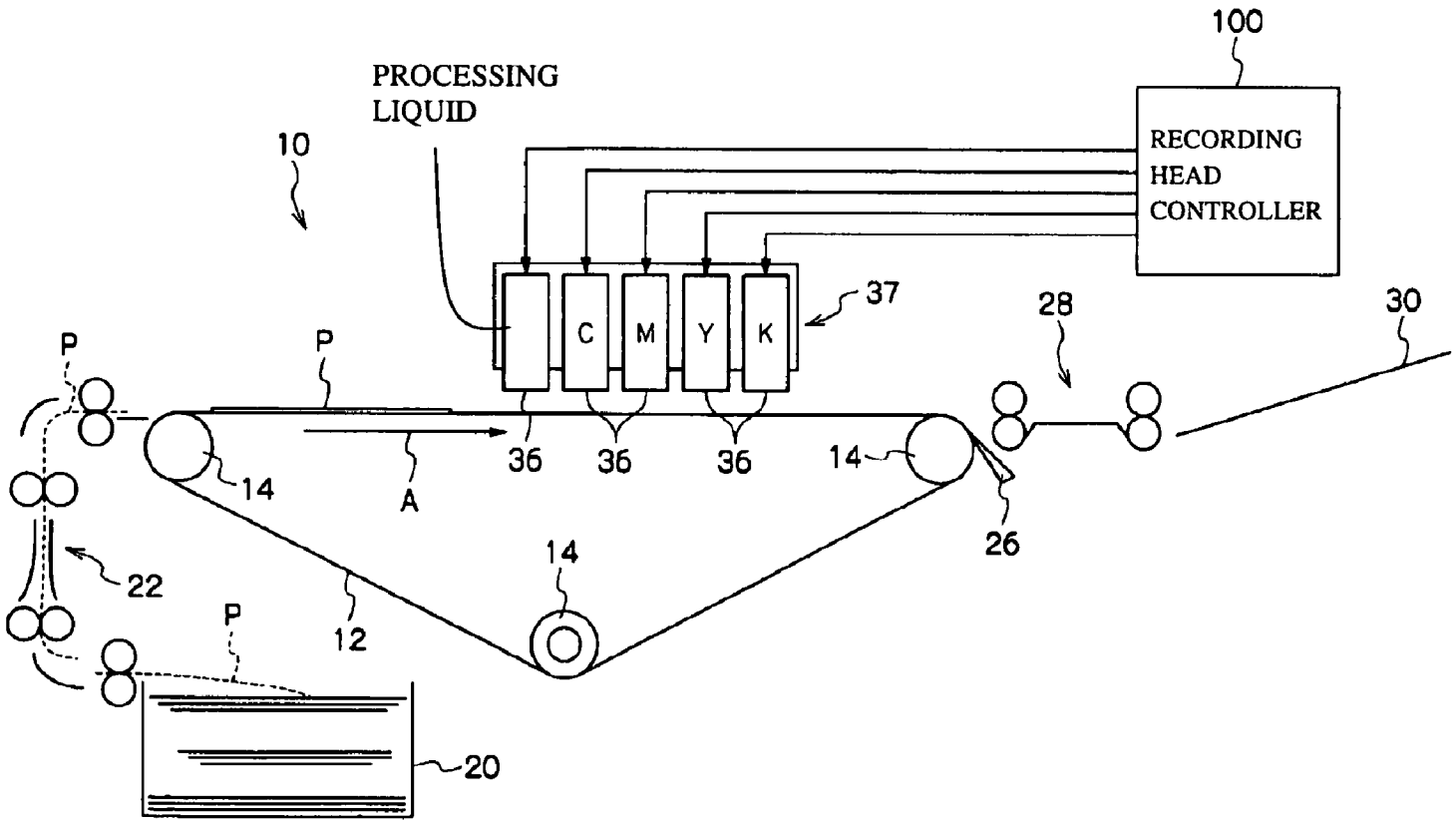
FIG. 1 is a schematic constitutional view illustrating an example of an inkjet recording apparatus working as the droplet ejecting apparatus of the invention.

FIG. 1 schematically illustrates the structure of FWA (Full Width Array)-type inkjet printer 10 according to this embodiment (hereinafter simply referred to as "printer").

In printer 10, conveyor belt 12 is wrapped around a plurality of rollers 14, and can be moved in the direction indicated by arrow A shown in FIG. 1. One or more of rollers 14 are driving rollers which are rotated by driving force generated by a driving device (not shown), and the other rollers are rotated according to the rotation of the driving rollers.

Printer 10 comprises sheet tray 20, and recording sheets (recording media) P for image recording are stacked and contained in sheet tray 20. Recording sheets P contained in sheet tray 20 are taken out one by one from the top by a pickup device (not shown), and then guided to sheet feed path 22. Then, sheet feed path 22 sends the recording sheets P to a predetermined position on conveyor belt 12. Conveyor belt 12 has a function of tightly holding the recording sheets P. Accordingly, the recording sheets P sent from sheet feed path 22 are conveyed in the direction indicated by arrow A while tightly held by conveyor belt 12.

Printer 10 comprises recording head unit 37 disposed on the downstream side of the recording sheet P feeding position on conveyor belt 12 along the conveyance path of the recording sheets P. The recording head unit 37 comprises five recording heads 36 respectively for the ejection of a reaction liquid, a cyan (C) color ink, a magenta (M) color ink, a yellow (Y) color ink, and a black (K) color ink in the order from the upstream side in the direction of the conveyance of the recording sheets P by conveyor belt 12. The recording sheets P are conveyed in the direction indicated by arrow A and sequentially face recording heads 36 for the respective colors. In the first embodiment, the scope of the term "recording liquid" covers the inks and the reaction liquid.

Figure 2:
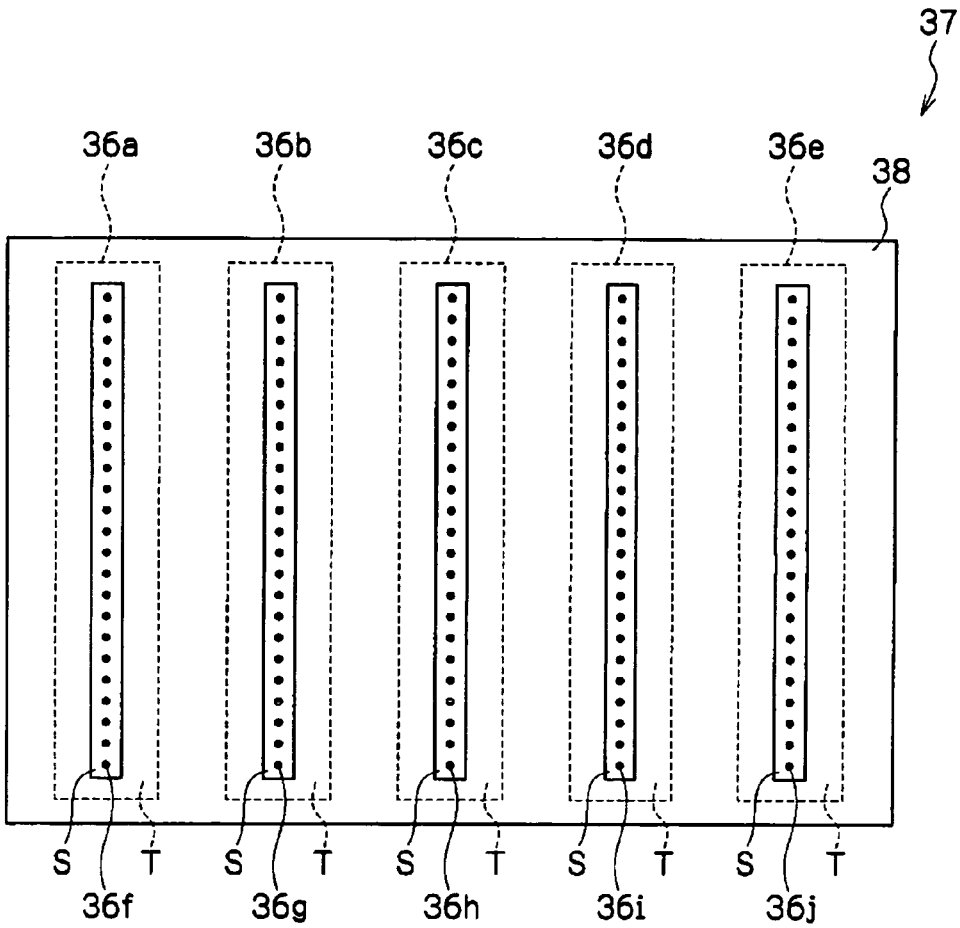
FIG. 2 is a schematic diagram illustrating an example of the droplet ejecting face of a recording head.

The recording head 36 for each color comprises many recording-liquid ejection nozzles (nozzle array) as shown in FIG. 2. The recording-liquid ejection nozzles are disposed along the entire width of conveyor belt 12, wherein the width is orthogonal to the direction indicated by arrow A.

Each recording head 36 is driven by recording head controller 100, and ink droplets of each color are ejected from the recording-liquid ejection nozzles disposed on recording head 36 for the color based on image data. As the result, ink droplets are sequentially ejected from the respective recording heads 36 to each recording sheet P tightly held by conveyor belt 12 when the recording sheet P faces the respective recording heads 36, thereby recording a full-color image on the recording sheet P.

The nozzle array may comprise plural nozzles disposed tandemly which eject the same printing liquid. The printing liquid ejected from the nozzle array may be supplied, for example from a printing liquid source (such as an ink tank) disposed above each recording head 36. The printing liquid may be ejected by a known method, and examples thereof include the so-called piezo-inkjet method using a piezoelectric element or the thermal inkjet method in which recording is conducted by using droplets formed by the application of thermal energy.

In the first embodiment, the driving system for ejecting droplets such as ink from the ejection nozzles is not particularly limited. The invention is particularly effective when the ejection method is the piezoelectric element involving the driving of a piezoelectric element. The driving mechanism will not be described in detail. In an example of the driving mechanism, a piezoelectric element is attached to a vibration plate constituting a part of the wall of a pressure chamber, and an electric potential is applied to the piezoelectric element to cause the vibration of the piezoelectric element which generates a pressure wave in the pressure chamber, and the pressure wave ejects ink or the like from a nozzle.

The reaction liquid has a function of accelerating the penetration of the respective inks of C, M, Y, and K into recording sheet P. The recording head 36 for the ejection of the reaction liquid eject droplets of the reaction liquid to every printing dot irrespective of image data. This ejection is a so-called "pretreatment." However, the recording head for the ejection of the reaction liquid is not essential for image formation.

Scraper 26 is disposed on the downstream side of the recording head unit 37 on the path of the feed of the recording sheet P by conveyor belt 12, and the scraper 26 is located at a suitable position relative to the roller 14 which is provided at bend of the sheet feed path. Scraper 26 separates the recording sheet P after image recording from conveyor belt 12, and sends the recording sheet P to discharge tray 30 via discharge path 28.

In the inkjet printer shown in FIG. 1, a two-liquid-type recording liquid set is used which comprises ink to be ejected as recording liquid droplets and a processing liquid capable of causing the aggregation of the pigment contained in the ink. However, in another example of the invention, only ink droplets are ejected and the processing liquid is not used. The details of the ink and processing liquid are described later.

In the inkjet printer shown in FIG. 1, the recording media are recording sheets P. The recording media may be paper, films, OHP sheets, or the like. The recording sheets P may be in the form of a roll or a strip, and the form of the recording sheets is not particularly limited.

In the following, a recording head as an example of the droplet ejecting unit of the invention is described in detail with reference to drawings.

FIG. 2 is a schematic diagram illustrating an example of a recording head according to the invention, and shows the printing droplet ejecting face (nozzle face) of the recording head usable in an inkjet recording apparatus of FWA system. In the invention, the recording head is not necessarily fixed, and may be a recording head which scans in the direction of the width of the recording medium, such as described later.

In FIG. 2, recording head unit 37 comprises recording heads 36 each having an ink tank which supplies the printing liquid to the nozzle array 36*f*, 36*g*, 36*h*, 36*i*, or 36*j*, nozzle faces 36*a* to 36*e*, and nozzle arrays 36*f* to 36*j*.

Five nozzle faces 36*a* to 36*e* for the respective colors are located on (recording liquid) droplet ejecting face 38. In the invention, each nozzle face has water-shedding film S near the nozzles (nozzle array) and has hydrophilic film T in the other region.

The term "water-shedding film" refers to a film having such a water-shedding property that the water contact angle is 90 degrees or larger. The term "hydrophilic film" refers to a film having such an affinity to water that the water contact angle is smaller than 20 degrees. The term "near the nozzles" refers to regions within 0.1 to 0.2 mm from the respective nozzles. As shown in FIG. 2, water-shedding film S may be provided in a continuous fashion to surround the nozzle array 36*f*, 36*g*, 36*h*, 36*i*, or 36*j*. Alternatively, water-shedding films S may be provided around the respective nozzles in a non-continuous fashion, depending on the space between adjacent nozzles.

The water-shedding film S prevents the adhesion of the recording liquid components and the like to near the nozzles at the ejection of the recording liquid. Therefore, the stability of the formation of the droplets of the recording liquid and the stability of the ejection directivity, which are important in inkjet recording, are maintained over long time.

Hydrophilic film T is provided in the other regions on the nozzle face than the area having water-shedding film S. Although hydrophilic films T are provided in the entire nozzle faces 36*a*, 36*b*, 36*c*, 36*d*, and 36*e* except for the area having water-shedding films S, hydrophilic films T do not have to be provided in the entire nozzle faces 36*a*, 36*b*, 36*c*, 36*d*, and 36*e* except for the area having water-shedding films S. As described above, the dirt such as ink shed by water-shedding film S should remain on hydrophilic film T. Therefore, it is preferable to provide hydrophilic film T in such a manner that hydrophilic film T have contact with water-shedding film S.

In the first embodiment, hydrophilic film T comprises a photocatalyst. The organic components contained in dirt adhered to the nozzle face such as ink (including dirt which has moved from near the nozzles to hydrophilic film T) undergoes photodecomposition reaction upon irradiation of the nozzle face with light owing to the action of the photocatalyst. Therefore, the dirt disappears or becomes a decomposed product which is easily removable by wiping or the like.

Particularly when a full-line head is used as the recording head as in the above example, the total quantity of the ejected ink is large and not every nozzle ejects ink when a sheet with a narrow width passes. Since dirt adhered to near the nozzles which are not used for the ejection is not removed by the ejection, ink components easily adhere and harden though such phenomena are unlikely to happen in a recording head of conventional PWA system.

In the first embodiment, the above constitution of the first embodiment can be applied to a full-line head, thereby preventing the adhesion and hardening of ink components and solving the problem.

The thickness of water-shedding film S is preferably 1 to 10 μm, more preferably 2 to 8 μm. When the film thickness is less than 1 μm, there is a possibility that the film may be removed by wiping or the like in a short period. When the film thickness is larger than 10 μm, it is sometimes difficult to form water-shedding film S with accuracy even by the production method described below.

The thickness of hydrophilic film T is preferably in the range of 2 to 8 μm for the same reasons as described above.

It is preferable to use a polymer containing a fluorine or silicon atom for the production of water-shedding film S. The use of a polymer containing a fluorine atom is particularly preferable. Specific examples thereof include polymers having fluorine-containing cyclic structures (for example, CYTOP CTX-105 manufactured by Asahi Glass Company), copolymers of fluoroolefins and vinyl ethers (for example, LUMIFLON manufactured by Asahi Glass Company), and photopolymerization-type fluororesin composition (for example, DEFENSA manufactured by DIC, Incorporated).

Hydrophilic film T is not particularly limited as long as it comprises a photocatalyst. When a binder is used in addition to the photocatalyst, examples of the binder include fluororesins, silicone resins, polyimide, polyether sulfone, polyether imide, polyacrylate, and polyetherether ketone.

The photocatalyst generally refers to a substance which is activated by the irradiation with light to generate an electron-hole pair and which allows adsorbed molecules to react upon diffusion of the electron-hole pair. The photocatalyst used in the invention is a catalyst which decomposes the organic components adsorbed on its surface into water and carbon dioxide through the photoactivation.

Examples of the photocatalyst include titanium oxide, strontium titanate, zinc oxide, and copper. Among them, titanium oxide is particularly preferable because of its high efficiency in the decomposition of organic substances upon irradiation with light. Titanium oxide is preferably anatase-type titanium oxide since anatase-type titanium oxide has a high activity compared to rutile-type titanium oxide and amorphous titanium oxide. Only a single photocatalyst may be used, or a mixture of two or more photocatalysts may be used in combination.

In the invention, the degree of decomposition of organic components under the same light irradiance is considered to be proportional to the photoactivation efficiency of the photocatalytic substance. In general, when the particle diameter of the photocatalyst is smaller, the specific surface area is larger and the photoactivation efficiency is higher, whereby the decomposition performance is higher. The average particle diameter of the photocatalyst used in the first embodiment is preferably 4 to 180 nm, more preferably 6 to 30 nm. When the average particle diameter is smaller than 4 nm, it is difficult to produce the particles and the handling property of the particles is likely to be problematic. When the average particle diameter is larger than 180 nm, the activity as a photocatalyst is insufficient in some cases.

In the following, a method of forming the water-shedding film and hydrophilic film according to the first embodiment is briefly described.

Figure 3A:
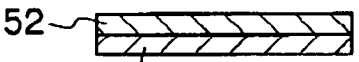
FIGS. 3A to 3F are schematic diagrams illustrating an example of a process of producing a recording head according to the invention, FIGS. 3A to 3E being cross-sectional views of the recording head at each stage of the production, and FIG. 3F being a perspective view of the droplet ejecting face after the production.

FIGS. 3A to F are schematic diagrams illustrating an example of the process of forming a water-shedding film and a hydrophilic film on the droplet ejecting face of the recording head according to the invention. In FIG. 3A, a polysulfone plate having a thickness of 100 μm is prepared as substrate 50 for the nozzle face. A photocatalyst sol (AT-series manufactured by Photo-Catalytic Materials) containing titanium oxide having an average particle diameter of 95 nm is spray-coated on the surface of the polysulfone plate in an amount of 100 to 200 ml/$m^2$. Then, the photocatalyst sol is dried to form hydrophilic film 52 having a thickness of 5 μm.

Figure 3B:
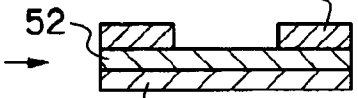
Figure 3C:
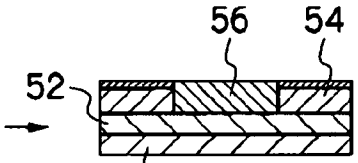
Figure 3D:
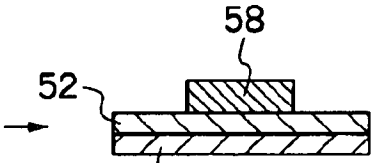

Subsequently, as shown in FIG. 3B, a photosensitive material having a thickness of about 25 μm comprising a dry film or the like is adhered to the surface of hydrophilic film 52, and the photosensitive material forms masking 54 in regions other than near the nozzles through patterning or the like. Then, fluorine-containing polymer 56 is provided on the entire surface by sputtering, as shown in FIG. 3C. Then, a resist separation liquid is applied to remove masking 54 to form water-shedding film 58, as shown in FIG. 3D.

Figure 3E:
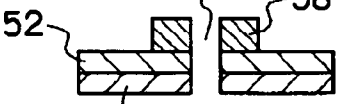

Finally, as shown in FIG. 3E, the substrate surface on the opposite side to the side on which the films have been provided is irradiated with light emitted from an excimer laser to form nozzles having a diameter of about 30 μm. In the first embodiment, the diameter of the nozzles is preferably in the range of 20 to 30 μm.

Figure 3F:
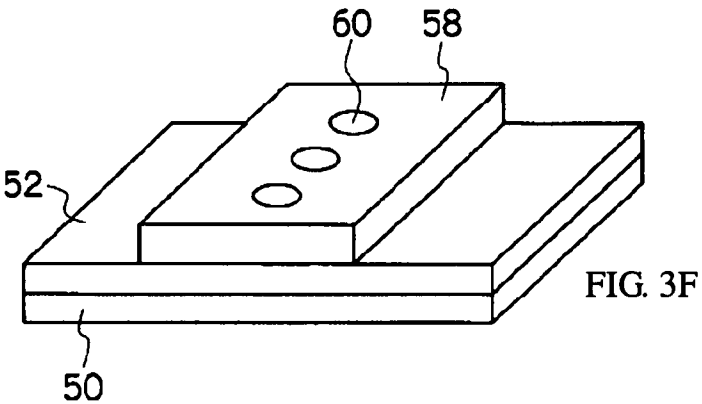

Through the above processes, the nozzle face having water-shedding film 58 comprising the fluorine-containing polymer near nozzles 60 along nozzles 60 and having hydrophilic film 52 containing titanium oxide as a photocatalyst in the other regions is produced, as shown in FIG. 3F.

Figure 4A:
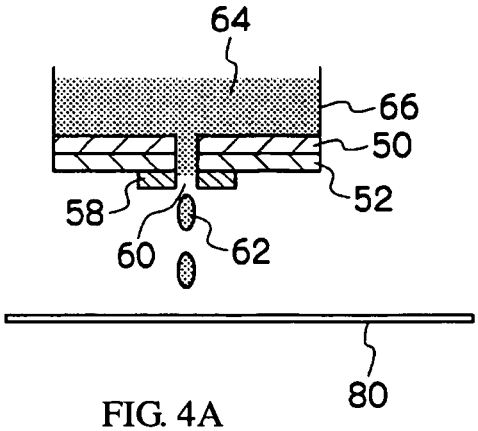
FIGS. 4A and 4B are schematic cross-sectional views illustrating the states of the recording head at use, FIG. 4A illustrating the state at the ejection of droplets and FIG. 4B illustrating the state at the irradiation of the droplet ejecting face with light.

FIGS. 4A and B are schematic perspective views illustrating the state of the recording head at use, the recording head using the nozzle face produced as described above as the recording-liquid droplet ejecting face.

FIG. 4A illustrates the state in which recording liquid 64 stored in recording liquid tank 66 is ejected as recording liquid droplets 62 from nozzle 60 to recording medium 80. In this state, ink components hardly adhere to near nozzle 60 owing to the function of water-shedding film 58. Even when ink components adhere to near nozzle 60, the adhered ink components are accumulated on hydrophilic film 52.

Figure 4B:
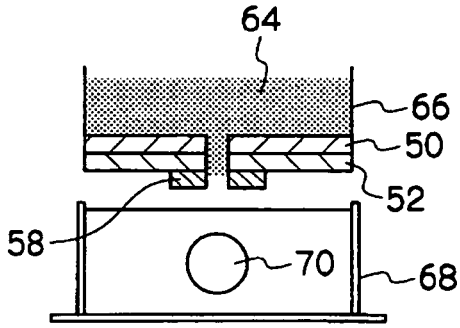

FIG. 4B illustrates the state in which the droplet ejecting face of the recording head after the completion of printing is capped by maintenance unit 68 so as to prevent drying of the nozzle.

In the first embodiment, it is preferable to provide an ultraviolet irradiation device which irradiates the droplet ejecting face with ultraviolet rays so as to decompose the dirt adhered to the droplet ejecting face by ultraviolet irradiation, as described above. In an example of the first embodiment, as shown in FIG. 4B, a black light 70 as the ultraviolet irradiation device is provided in maintenance unit 68, and ultraviolet irradiation is conducted during the non-printing state. This example is preferable from the viewpoint of efficiency. In FIG. 4B, the meanings of the other reference characters are the same as in FIG. 4A.

Most of the photocatalysts described above as examples have absorption wavelength regions equal to or shorter than 400 nm. Accordingly, the ultraviolet irradiation device usable in the invention is preferably capable of emitting a near-ultraviolet to ultraviolet light having a wavelength which is not longer than 400 nm. Examples of the ultraviolet irradiation devices include xenon lamps, high-pressure mercury lamps, black lights, and sterilization lamps.

In order to obtain a sufficiently high decomposition efficiency with a short-time light irradiation, the intensity of the ultraviolet rays is preferably 0.01 to 10 $mJ/cm^2 \cdot s$, more preferably 0.2 to 1 $mJ/cm^2 \cdot s$.

Through the ultraviolet irradiation, the organic components of the adhered dirt are decomposed by photodecomposition, so that the organic components directly disappear or remain on the droplet ejecting face in the form which is easily removable. The components remaining on the droplet ejecting face are removed by wiping with a rubber wiper blade or the like conducted before the next printing cycle.

When a full-line head is used, the wiping is preferably conducted along the entire width of the full-line head.

In the following, a second embodiment of the invention is described. Firstly, the schematic constitution of inkjet recording apparatus 110 is described.

Figure 5:
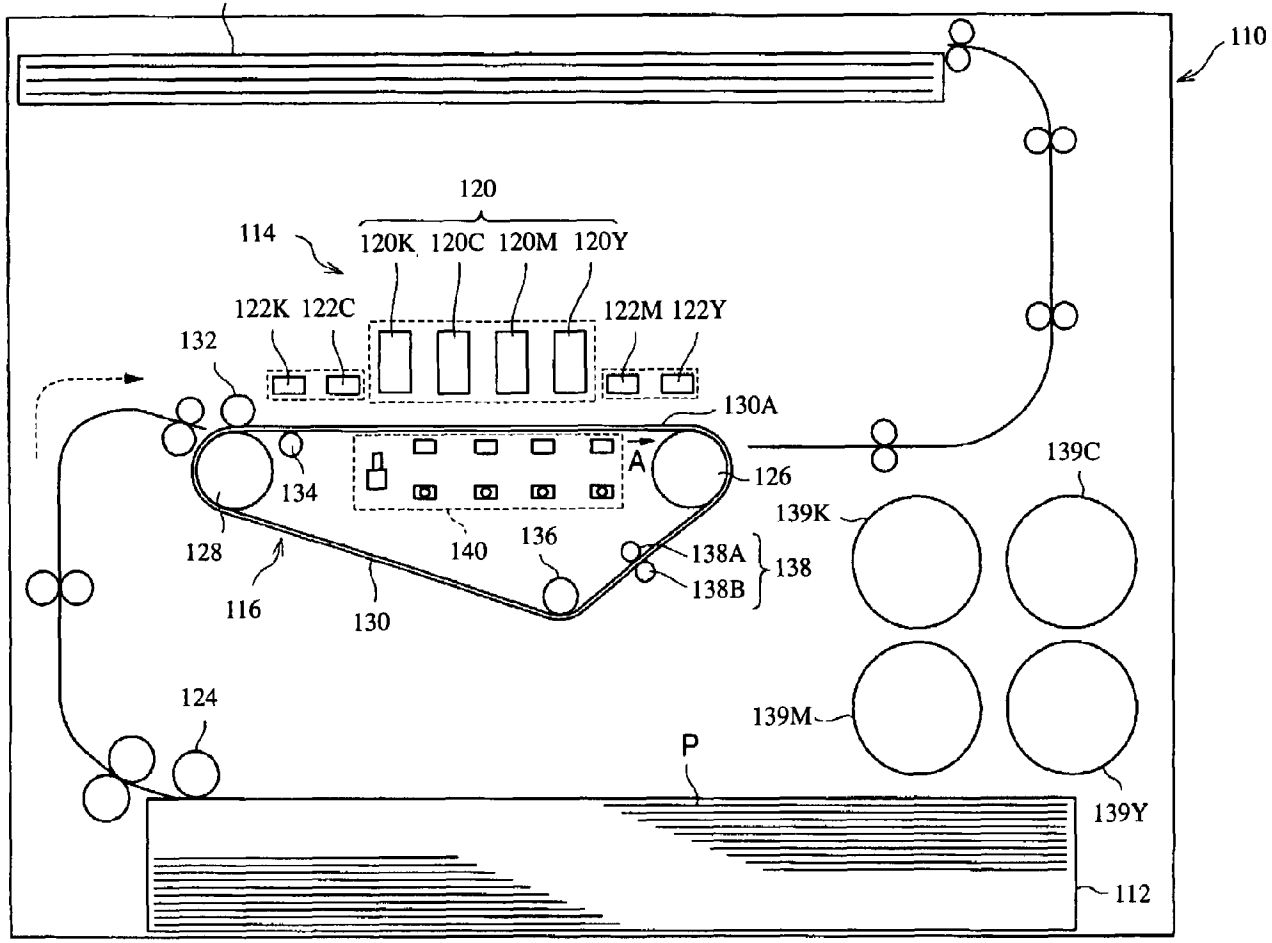
FIG. 5 is a schematic diagram illustrating the constitution of an image recording apparatus according to an embodiment of the invention at printing.
Figure 6:
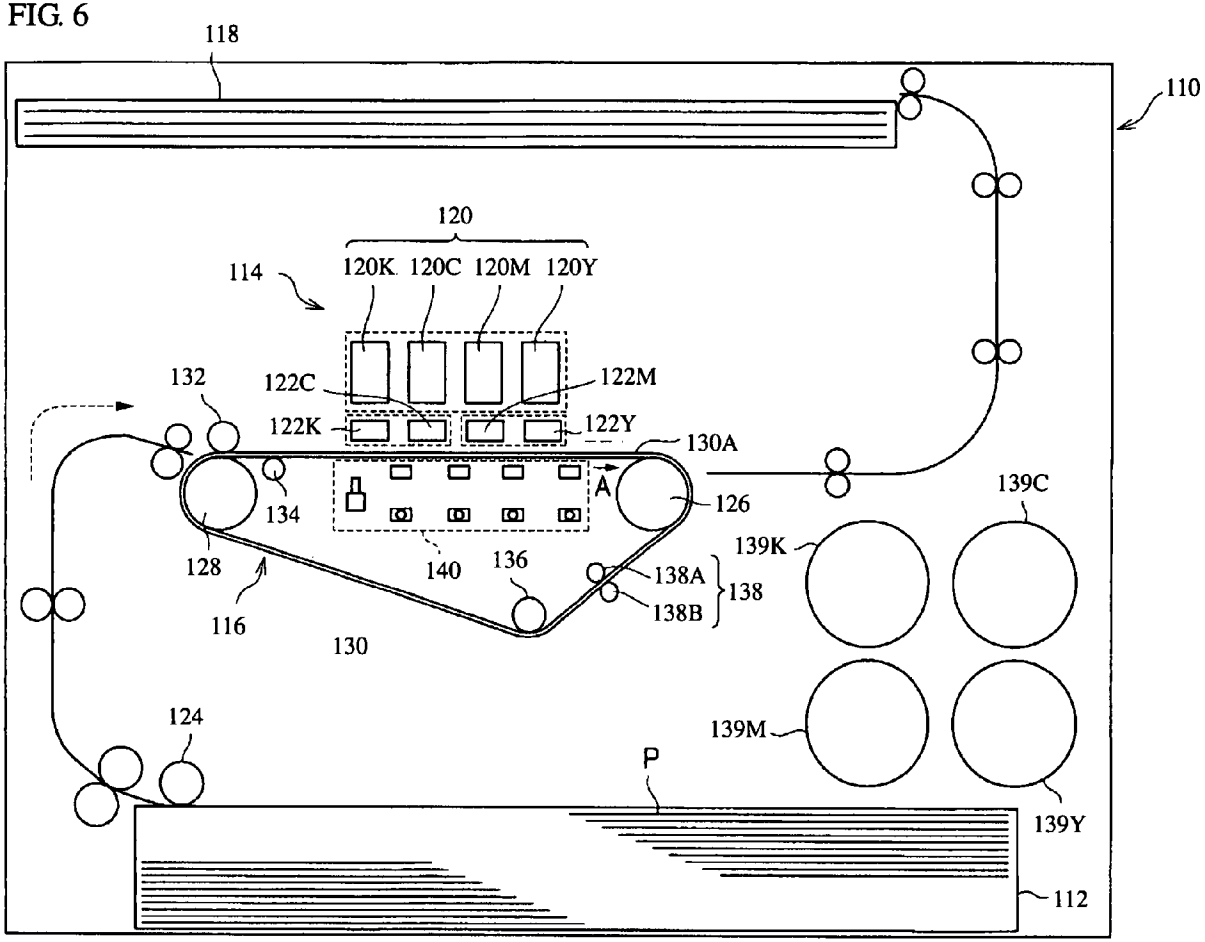
FIG. 6 is a schematic diagram illustrating the constitution of an image recording apparatus according to an embodiment of the invention at maintenance.

As shown in FIGS. 5 and 6, inkjet recording apparatus 110 comprises sheet feed tray 112 which contains sheets P as an example of the recording media, recording unit 114 which records image on sheets P supplied from sheet feed tray 112, conveyor device which conveys sheets P to recording unit 114, and discharge tray 118 which contains sheets P on which images were recorded by recording unit 114.

Recording unit 114 comprises recording head 120, and recording head 120 has a recording width which is equal to or longer than the maximum possible width of the sheets to be subjected to recording by inkjet recording apparatus 110. In other words, recording head 120 is a recording head of so-called Full Width Array (FWA) capable of single-pass printing.

Recording head 120 comprises, in the order from the upstream in the direction of the conveyance of sheets P, black (K) recording head 120K, cyan (C) recording head 120 C, magenta (M) recording head 120 M, and yellow (Y) recording head 120Y. Recording head 120 ejects ink droplets by a known method such as the thermal system or the piezoelectric system. The ink may be an aqueous ink, an oil-based ink, a solvent-based ink, or an ink selected from the other various inks. Inkjet recording apparatus 110 further comprises ink tanks 139K, 139C, 139M, and 139Y which supply inks respectively to recording heads 120K, 120C, 120M, and 120Y.

Recording heads 120K, 120C, 120M, and 120Y are equipped with maintenance units 122K, 122C, 122M, and 122Y, respectively. Maintenance units 122K, 122C, 122M, and 122Y are separated into two groups (the group of black (K) and cyan (C), and the group of magenta (M) and yellow (Y)), and each can be moved between the standby position at printing and the maintenance position at maintenance of the recording head 120 K, 120C, 120M, and 120Y.

Each of maintenance units 122K, 122C, 122M, and 122Y comprises a dummy jet receiver, a wiping member, and a cap. At the maintenance of recording heads 120K, 120C, 120M, and 120Y, respective recording heads 120K, 120C, 120M, and 120Y rises to a predetermined distance, and maintenance units 122K, 122C, 122M, and 122Y face the nozzle faces of recording heads 120K, 120C, 120M, and 120Y, respectively.

Sheets P in sheet feed tray 112 are taken out one by one by pickup roller 124, and then conveyed to recording unit 114 by conveyor device 116. Conveyor device 116 comprises conveyor belt 130 which conveys sheets P such that the printing face of sheets P faces recording head 120. Conveyor belt 130 contacts driving roller 126 disposed on the downstream side of recording head 120 and driven roller 128 disposed on the upstream side of recording head 120. Conveyor belt 130 can be moved in the direction (clockwise direction) indicated by arrow A shown in Figs such that conveyor belt 130 moves around (rotates).

Nip roller 132 is disposed above driven roller 128 such that nip roller 132 contacts the surface of conveyor belt 130 and such that nip roller 132 is driven by the movement of conveyor belt 130. Charging roller 134 is disposed such that charging roller 134 contacts the surface of conveyor belt 130 on the same side as the point of contact between conveyor belt 130 and driven roller 128 and such that charging roller 134 is driven by the movement of conveyor belt 130.

Charging roller 134 electrifies (charges) conveyor belt 130. Sheets P are electrostatically adhered to conveyor belt 130, and conveyed by conveyor belt 130. Charging roller 134 may be always in contact with conveyor belt 130, or may be set apart from conveyor belt 130 every time sheet P passes.

Tension roller 136 is provided at a lower position than driven roller 128 and driving roller 126. Tension roller 136 contacts the rear side of conveyor belt 130 (the side having the contact point between driving roller 126 and conveyor belt 130 and the contact point between driven roller 128 and conveyor belt 130). Tension roller 136 is driven by the movement of conveyor belt 130. Two cleaning rollers 138 are provided between tension roller 136 and driving roller 126. Cleaning rollers 138 consist of fixed roller 138A and movable roller 138B. Fixed roller 138 A is in contact with the rear side of conveyor belt 130 and is driven by the movement of conveyor belt 130. Movable roller 138B can be brought into contact with the front side of conveyor belt 130 so that movable roller 138B is driven by the movement of conveyor belt 130, and can be set apart from conveyor belt 130 as necessary.

Figure 7:
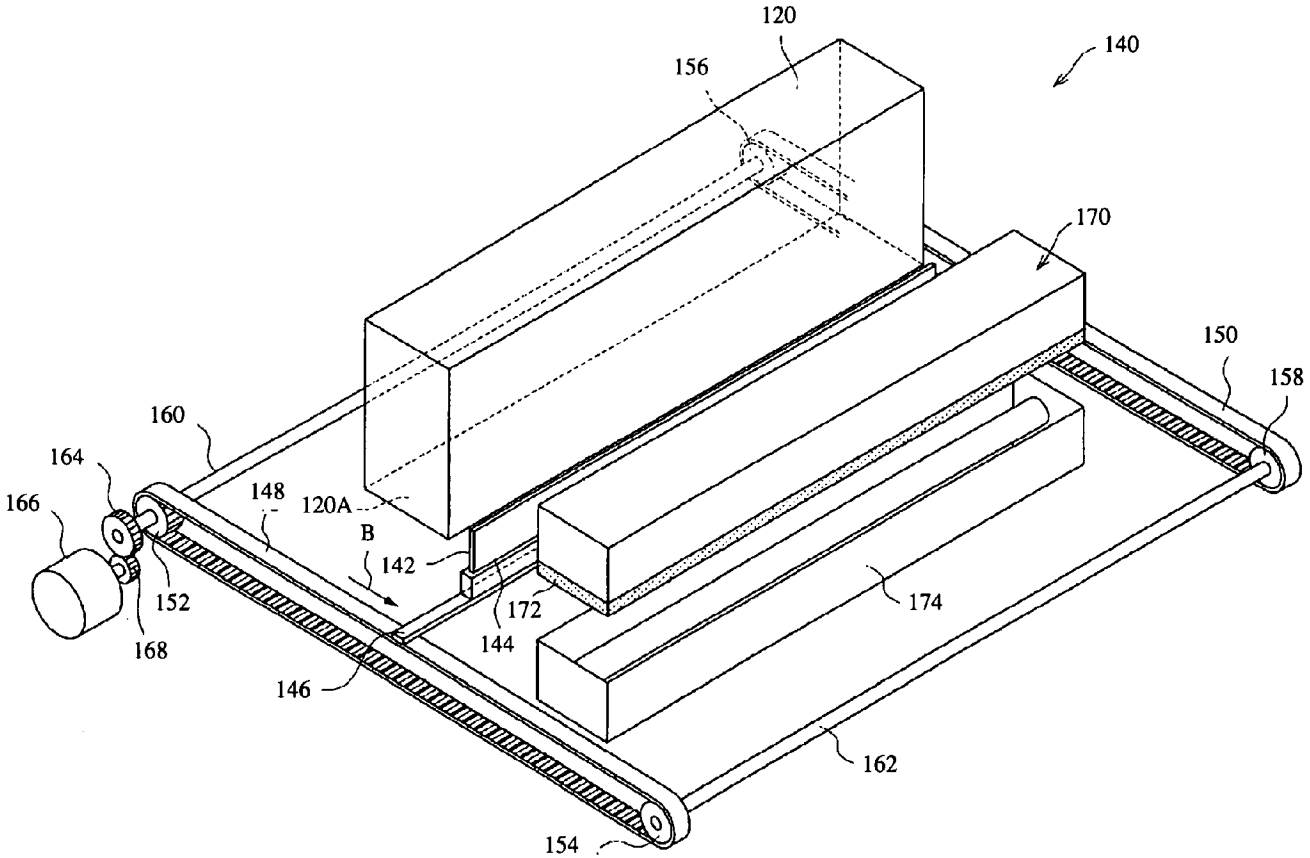
FIG. 7 is a perspective view illustrating a cleaning device and a recording head mounted on an image recording apparatus according to an embodiment of the invention.

Cleaning device 140 is disposed below recording head 120. Cleaning device 140 is provided below conveying face 130A of conveyor belt 130 between driving roller 126 and driven roller 128 (see FIG. 5), and comprises rubber blade 142 which wipes nozzle face 120A of recording head 120, as shown in FIG. 7. Rubber blade 142 is in the shape of a plate whose longitudinal direction is the longitudinal direction of recording head 120. One end of the width of rubber blade 142 faces nozzle face 120A of recording head 120, and the end (edge) wipes nozzle face 120A of recording head 120. The other end of blade 142 is inserted into box-like holder 144.

Holder 144 is fixed on support 146 in the shape of a long plate having a length which is longer than the length of holder 144. The ends of the length of support 146 are fixed to belt 148 and belt 150, respectively. Guide rails (not shown) which guide support 146 are provided on the inner sides of belts 148 and 150.

Belts 148 and 150 are disposed in parallel with the conveyance direction. Belt 148 is wrapped around pulleys 152 and 154 whose axes are supported by a side plate. Belt 150 is wrapped around pulleys 156 and 158 whose axes are supported by a side plate. Pulley 152 and pulley 156 are connected by shaft 160. Pulley 154 and pulley 158 are connected by shaft 162.

Gear 164 is connected to pulley 152. Gear 164 engages with gear 168 connected to motor 166. When motor 166 is driven, the driving force generated by motor 166 is transmitted to pulley 152 via gears 168 and 164. When pulley 152 is rotated by the driving force generated by motor 166, pulley 156 is also rotated owing to the presence of shaft 160, and pulleys 154 and 158 are also rotated owing to the mediation by belts 148 and 150, respectively. Accordingly, belts 148 and 150 are moved in the direction which is parallel to the direction of the movement of sheet P. The movement of belts 148 and 150 moves blade 142 via support 146 and holder 144 in the direction parallel to the conveyance direction. Owing to this constitution, blade 142 can be moved in the direction of the conveyance of sheet P.

Blade 142 at standby time is positioned on the upstream side of the ejection area of recording head 120. Therefore, when blade 142 is moved in the conveyance direction according to the movement of belts 148 and 150, the edge of blade 142 scrapes ink (deposit of resins or the like contained in ink droplets) adhered to the nozzle face of recording head 120.

There is an opening (not shown) on conveyor belt 130 (see FIG. 5) having such a size that nozzle face 120A of recording head 120 can pass the opening. Recording head 120 can be moved in the vertical direction by a moving mechanism (not shown), and the moving mechanism can move nozzle face 120A down to such a position (hereinafter referred to as "cleaning position") as to be on the same plane as wiping part 172 of blade wiping member 170.

When recording head 120 is at the cleaning position, blade wiping member 170 is located on the downstream side of recording heads 120K, 120C, 120M, and 120Y. Blade wiping member 170 is in the form of a long plate whose length is nearly the same as the length of recording head 120, and has wiping part 172 comprising polyurethane sponge on the lower surface.

Wiping part 172 comprises a polyurethane sheet (formed by injection molding of polyurethane for molding, RESAMINE PH-4595 manufactured by Dainichiseika Color and Chemicals Mfg. Co., Ltd.) having a thickness of 5 mm coated with a photocatalyst sol (AT-series, manufactured by Photo-Catalytic Materials). In this example of the second embodiment, the polyurethane sheet is coated with a titanium oxide sol as the photocatalyst sol with an air spray brush (HIP-TR1, manufactured by Iwata) in a coating amount of 100 to 200 ml/$m^2$ such that the thickness of the resultant titanium oxide film is 1 μm or larger.

The coating method may be selected from, in addition to spray coating methods, usual coating methods such as dipping methods and spin coating methods. After coating, drying may be conducted at room temperature or may be subjected to drying by heating to 100 to 180° C. A primer layer may be formed before coating in order to improve the adhesion to the polyurethane sheet. A protective layer may be formed in order to prevent the deterioration of the polyurethane sheet caused by the photocatalyst.

Figure 8A:
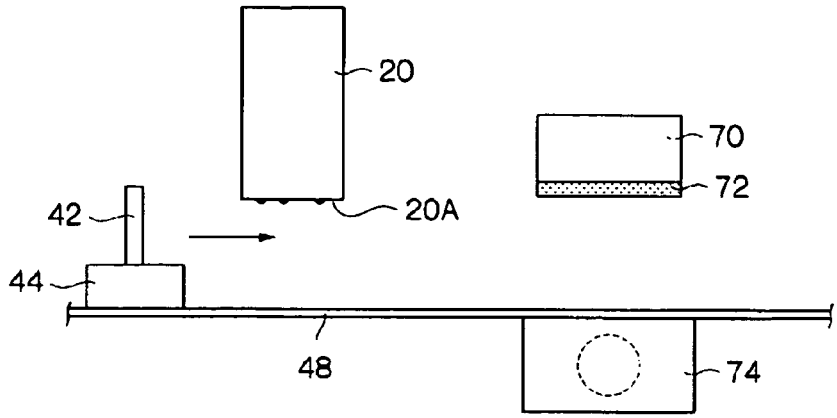
FIGS. 8A to 8C are side views illustrating a conveyor device and a recording head mounted on an image recording apparatus according to an embodiment of the invention.
Figure 8B:
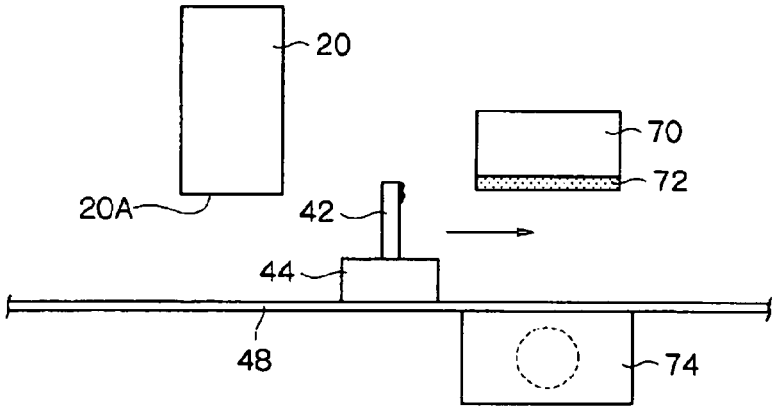
Figure 8C:
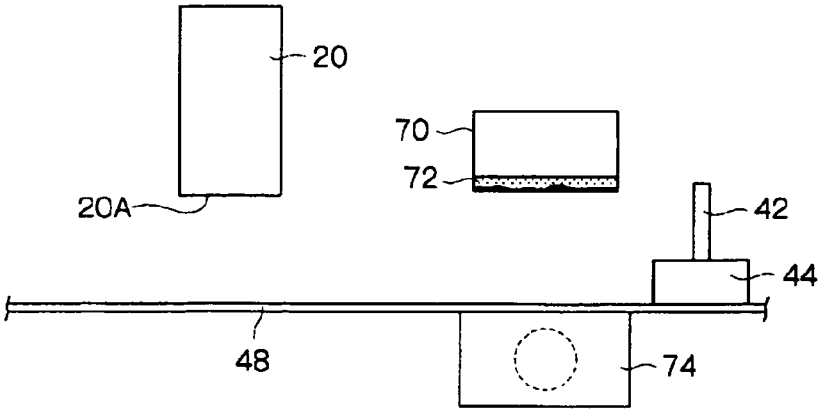

Wiping part 172 prepared by the above method is positioned such that the lower surface (the face for wiping blade 142) is at the same height as the nozzle face 120A of recording head 120 at cleaning position, as shown in FIG. 8A. According to this constitution, when blade 142 is moved in the conveyance direction (downstream direction), the edge of blade 142 scrapes ink adhered to nozzle face 120A of recording head 120, as shown in FIG. 8B. The ink adhered to the tip of blade 142 is wiped by wiping part 172 when blade 142 is moved further in the downstream direction, as shown in FIG. 8C. The meaning of the other reference characters in FIGS. 8A to C are the same as in FIG. 7.

As shown in FIGS. 7A to C, a fluorescent lamp 174 which emits ultraviolet rays is disposed below blade wiping member 170, and wiping part 172 of blade wiping member 170 is irradiated with the light (ultraviolet light) emitted from fluorescent lamp 174.

When wiping part 172 is irradiated with ultraviolet rays, the titanium oxide sol (hereinafter referred to as titanium oxide) coated on wiping part 172 generates active oxygen. The active oxygen decomposes ink (organic compounds contained in ink) adhered to wiping part 172 into water, carbon dioxide, and the like. The decomposition products are released to the air.

In the following, the mechanism of the example of the second embodiment is explained.

Cleaning device 140 removes adhered ink from nozzle face 120A of recording head 120 in the non-printing time. In the non-printing time, the opening provided on conveyor belt 130 is positioned just under recording head 120, and recording head 120 is allowed to go down by a moving mechanism (not shown). As a result, nozzle face 120A of recording head 120 protrudes from the opening to under the conveying face of conveyor belt 130. At this time, nozzle face 120A of recording head 120 is at approximately the same height as wiping part 172 of blade wiping member 170.

When pulley 152 is rotated by the operation of motor 166, belts 148 and 150 move, and the movement of belts 148 and 150 is transmitted to blade 142 via support 146 and holder 144. Therefore, blade 142 in the standby state positioned on the upstream side of recording head 120 is moved in the conveyance direction (in the direction indicated by arrow B).

During the movement of blade 142, the edge of blade 142 comes into sliding contact with nozzle face 120A of recording head 120 so as to scrape the ink which adhered to nozzle face 120A through leakage from the nozzles, bouncing back from sheet P, or the like. Then, blade 142 moves further in the downstream direction to come into sliding contact with wiping part 172 of blade wiping member 170, whereby the ink adhered to blade 142 which was scraped off nozzle face 120A is wiped off by wiping part 172. The ink wiped off by wiping part 172 is decomposed by titanium oxide coated on wiping part 172.

As described above, ink adhered to nozzle face 120A is scraped by blade 142 and then wiped off by wiping part 172, and finally decomposed by the photocatalytic action of titanium oxide coated on wiping part 172 to be released to the air. Therefore, adhered ink does not accumulate on wiping part 172, and the accumulation of adhered ink is also suppressed on blade 142. Accordingly, the cleaning device maintains its ability to remove the ink adhered to nozzle face 120A, and ink adhered to nozzle face 120A is completely removed every time blade 142 comes into sliding contact with nozzle face 120A, whereby the directivity of the ink droplets ejected from recording head 120 maintained stable.

The ink adhered to blade 142 is wiped off by wiping part 172 and instantly decomposed to be released to the air when titanium oxide, which has high ability to decompose the organic compounds contained in the ink, is used as the photocatalyst to be coated on wiping part 172 of blade wiping member 170. Accordingly, adhered ink does not accumulate on wiping part 172.

Even when blade wiping member 170 is located at a position not exposed to light coming from outside of inkjet recording apparatus 110 (such as light from a fluorescent light in the room or the sunlight), titanium oxide coated on wiping part 172 can be activated by providing a fluorescent lamp 174 below blade wiping member 170.

By adopting the constitution in which blade 142 provided along the longitudinal direction of recording head 120 is moved in the direction orthogonal to the longitudinal direction of recording head 120 to remove the dirt adhered to nozzle face 120A of recording head 120, the traveling distance of blade 142 is smaller than in the case where recording head 120 is moved in the longitudinal direction of recording head 120. Accordingly, space for the movement of blade 142 is not required, and inkjet recording apparatus 110 can be compact.

Since nozzle face 120A is located approximately on substantially the same plane as wiping part 172 upon removal of the ink adhered to nozzle face 120A, the horizontal movement of blade 142 achieves the removal of the ink adhered to nozzle face 120A and wiping off of the ink adhered to blade 142 by wiping part 172. Therefore, there is no need for the vertical movement of blade 142, and the system for moving blade 142 can be simple.

In the above example of the second embodiment, an inkjet recording apparatus utilizing an inkjet system is described. The inkjet system may be, for example, thermal inkjet system, piezoelectric inkjet system, continuous flow inkjet system, or electrostatic attraction inkjet system. Other inkjet systems are also usable.

The driving method for ejecting ink droplets from recording head is not particularly limited, and may be selected from known methods such as thermal system and piezoelectric system. The invention is particularly effective when piezoelectric system using the operation of a piezoelectric element is used. When the quantity of ejected ink is made variable by providing a piezoelectric element, the ejection direction of ink droplets is easily affected by dirt on the nozzle face of the recording head. However, when cleaning of the nozzle face is conducted stably owing to the action of a photocatalyst, the ejection direction of ink droplets is stabilized in an inkjet recording apparatus which uses a piezoelectric element.

In the above explanation, a recording head which ejects ink droplets is used for the explanation. However, the invention can be applied to a recording head which ejects a processing liquid having a function of causing the aggregation of the pigment contained in the ink droplet.

In the above example of the second embodiment, an inkjet recording apparatus is used as an example of the droplet ejecting apparatus. However, the application of the invention is not limited thereto, and may be applied to various applications including droplet ejecting apparatuses for direct circuit drawing method of directly forming a circuit pattern on a substrate, droplet ejecting apparatuses for color filter formation, and droplet ejecting apparatuses for the formation of optical elements for plane-emission luminescent elements.

The droplet ejecting apparatus according to the invention may be an apparatus used for the recording of characters and images on sheets P whose example include recording apparatuses such as facsimile machines, copy machines, copy-printer complex machines, and output machines for workstations and the like. In addition, the droplet ejecting apparatus according to the invention is also usable for the production of color filters for display involving ejection of color inks onto polymer films or glass.

In other words, the "recording medium" used in the invention is not limited to sheet P made of paper, and may be an OHP sheet or a substrate on which a circuit pattern or the like is to be formed. In the invention, the scope of the term "image" include not only general images (such as characters, pictures, and photographs), but also dot patterns obtained by providing ink droplets onto recording media, such as circuit patterns.

In the following, inks and processing liquids (recording liquids) usable in the invention (both the first and second embodiments) are described.

The printing liquids to be ejected from the nozzles of the recording head are preferably color inks comprising a pigment or dye, a water-soluble solvent, and water, and a processing liquid having the function of causing the aggregation of the pigment contained in the inks. In the above explanation of the first embodiment, a processing liquid is used separately from the inks; however, the processing liquid may comprise a pigment so as to be used as an ink (e.g., a yellow ink).

The ink comprises a pigment or dye, a water-soluble solvent, and water. The present invention is effective when inks containing pigments and resins for improving the dispersion property and fixability of the pigments are used.

The pigment may be an organic pigment or an inorganic pigment. Examples of black pigments include carbon black pigments such as furnace black, lamp black, acetylene black and channel black. In addition to a black pigment and pigments of three primary colors of cyan, magenta, and yellow, other pigments may be used such as: pigments of specific colors such as red, green, blue, brown, and white; metallic pigments such as gold color pigments and silver color pigments; colorless or light-colored extender pigments; and plastic pigments. A pigment newly synthesized for the invention is also usable.

Specific examples of black pigments include: RAVEN 7000, RAVEN 5750, RAVEN 5250, RAVEN 5000, ULTRA II, RAVEN 3500, RAVEN 2000, RAVEN 1500, RAVEN 1250, RAVEN 1200, RAVEN 1190, ULTRAII, RAVEN 1170, RAVEN 1255, RAVEN 1080, and RAVEN 1060 (manufactured by Columbian Chemicals Company); REGAL 400R, REGAL 330R, REGAL 660R, MOGUL L, BLACK PEARLS L, MONARCH 700, MONARCH 800, MONARCH 880, MONARCH 900, MONARCH 1000, MONARCH 1100, MONARCH 1300, and MONARCH 1400 (manufactured by Cabot Corporation); Color Black FW1, Color Black FW2, Color Black FW2V, Color Black 18, Color Black FW200, Color Black S150, Color Black S160, Color Black S170, PRINTEX 35, PRINTEX U, PRINTEX V, PRINTEX 140U, PRINTEX 140V, Special Black 6, Special Black 5, Special Black 4A, and Special Black 4 (manufactured by Degussa); No. 25, No. 33, No. 40, No. 47, No. 52, No. 900, No. 2300, MCF-88, MA 600, MA 7, MA 8, and MA 100 (manufactured by Mitsubishi Chemical Co., Ltd.).

Examples of pigments of cyan color include: C. I. Pigment Blue-1, -2, -3, -15, -15:1, -15:2, -15:3, -15:4, -16, -22, and -60.

Examples of pigments of magenta color include: C. I. Pigment Red-5, -7, -12, -48, -48:1, -57, -112, -122, -123, 146, -168, -184, and -202.

Examples of pigments of yellow color include C. I. Pigment Yellow-1, -2, -3, -12, -13, -14, -16, -17, -73, -74, -75, -83, -93, -95, -97, -98, -114, -128, -129, -138, -151, and -154.

In addition, pigments that are self-dispersible in water are also usable as pigments. The term "pigments that are self-dispersible in water" refers to pigments which have many water-soluble groups on their surfaces and which can take stable dispersion state in water in the absence of polymer dispersants. Specifically, pigments self-dispersible in water can be prepared, for example by subjecting usual pigments to surface modifying treatments, such as acid-base treatments, treatments with coupling agents, polymer graft treatments, plasma treatments, and oxidation/reduction treatments.

Examples of pigments self-dispersible in water include CAB-O-JET 200, CAB-O-JET 300, IJX 253, IJX 266, IJX 444, IJX 273, and IJX 55 (manufactured by Cabot Corporation), MICROJET BLACK CW-1 and CW2 (manufactured by Orient Chemical Industries, Ltd.), which are commercially available, in addition to the pigments prepared by surface modification of the above pigments.

The amount of pigment to be used may be 0.5 to 20% by weight, preferably 1 to 10% by weight, based on the amount of ink. When the amount of pigment in ink is smaller than 0.5% by weight, the optical density is likely to be insufficient. When the amount of pigment exceeds 20% by weight, ejection characteristics of ink may be instable.

It is preferable to add a polymer (resin) dispersant to the ink for the purpose of dispersing the pigment in the ink. In the invention, a polymer substance used for dispersing the colorant (pigment) is referred to as "polymer dispersant."

The polymer substance used for dispersing the colorant may be a water-soluble polymer substance or a water-insoluble polymer substance such as an emulsion or self-dispersible particles. Examples thereof include nonionic compounds, anionic compounds, cationic compounds, and amphoteric compounds. For example, the polymer substance may be a copolymer containing a monomer having an α,β-ethylenic unsaturated group.

Specific examples of the monomer having an α,β-ethylenic unsaturated group include acrylic acid, methacrylic acid, crotonic acid, itaconic acid, an itaconic acid monoester, maleic acid, a maleic acid monoester, fumaric acid, a fumaric acid monoester, vinylsulfonic acid, styrenesulfonic acid, sulfonated vinylnaphthalene, vinyl alcohol, acrylamide, methacryloxyethyl phosphate, bismethacryloxyethyl phosphate, methacryloxyethylphenyl acid phosphate, ethylene glycol dimethacrylate, diethylene glycohol dimethacrylate, styrene, α-methylstylene, styrene derivatives such as vinyltoluene, vinylcylohexane, vinylnaphthalene, a vinylnaphthalene derivative, an acrylic acid alkyl ester, an acrylic acid phenyl ester, a methacrylic acid alkyl ester, a methacrylic acid phenyl ester, a methacrylic acid cycloalkyl ester, a crotonic acid alkyl ester, an itaconic acid dialkyl ester, and maleic acid dialkyl ester.

The polymer dispersant may be a polymer or copolymer obtained by the copolymerization of one or more of the above monomers having an α,β-ethylenic unsaturated group. Specific examples thereof include polyvinyl alcohol, polyvinyl pyrrolidone, a styrene-styrene sulfonate copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an alkyl acrylate-acrylic acid copolymer, an alkyl methacrylate-methacrylic acid copolymer, a styrene-alkyl methacrylate-methacrylic acid copolymer, a styrene-alkyl acrylate-acrylic acid copolymer, a styrene-phenyl methacrylate-methacrylic acid copolymer, and a styrene-cyclohexyl methacrylate-methacrylic acid copolymer.

The polymer dispersant is preferably added in a range of from about 0.1 to 3% by weight based on the amount of ink. When the amount of polymer dispersant exceeds 3% by weight, the viscosity of the ink is high and ejection characteristics of the ink are likely to be instable. When the amount of polymer dispersant is below 0.1% by weight, the dispersion stability of the pigment is likely to be deteriorated. The amount of polymer dispersant to be added is more preferably 0.15 to 2.5% by weight, still more preferably 0.2 to 2% by weight.

Examples of the water-soluble organic solvent contained in the ink include polyhydric alcohols, polyhydric alcohol derivatives, nitrogen-containing solvents, alcohols, and sulfur-containing solvents. Specific examples of polyhydric alcohols include ethylene glycol, diethylene glycol, propylene glycol, butylene glycol, triethylene glycol, 1,5-pentanediol, 1,2,6-hexanetriol, and glycerin. Specific examples of polyhydric alcohol derivatives include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and ethylene oxide adducts of diglycerin. Specific examples of nitrogen-containing solvents include pyrrolidone, N-methyl-2-pyrrolidone, cyclohexylpyrrolidone, and triethanolamine. Specific examples of alcohols include ethanol, isopropyl alcohol, butyl alcohol, and benzyl alcohol. Specific examples of sulfur-containing solvents include thiodiethanol, thiodiglycerol, sulfolane, and dimethylsulfoxide. It is also possible to use propylene carbonate, ethylene carbonate, or the like as the water-soluble organic solvent.

It is preferable to use at least one water-soluble organic solvent in the ink. The content of water-soluble organic solvent in the ink may be 1 to 60% by weight, preferably 5 to 40% by weight. When the amount of water-soluble organic solvent in the ink is below 1% by weight, the obtained optical density is likely to be insufficient. When the amount is larger than 60% by weight, the viscosity of the ink is high and the ejection characteristics of the ink are likely to be instable.

The ink may further comprise a surfactant. The surfactant may be a compound having a hydrophilic portion and a hydrophobic portion. The surfactant may be an anionic surfactant, a cationic surfactant, an amphoteric surfactant, or a nonionic surfactant. It is also possible to use a polymer dispersant as a surfactant.

Among them, it is preferable to use a nonionic surfactant in view of the dispersion stability of the pigment. Further, from the viewpoint of controlling the penetration property, acetylene glycol, oxyethylene adducts of acetylene glycol, polyoxyethylene alkyl ether, and the like are particularly preferable.

The amount of surfactant to be added is preferably lower than 10% by weight (more preferably 0.01 to 5% by weight, still more preferably 0.01 to 3% by weight) based on the amount of ink. When the amount of surfactant is 10% by weight or larger, the optical density and the storage stability of the pigment ink are deteriorated in some cases.

Compounds selected from the following may be optionally added to the ink: substances for the control of characteristics (e.g., the improvement of the ink ejection property and the like), such as polyethyleneimine, polyamines, polyvinyl pyrrolidone, polyethylene glycol, ethylcellulose, and carboxymethylcellulose; compounds for the adjustment of conductivity or pH, such as potassium hydroxide, sodium hydroxide and lithium hydroxide; and pH buffers, antioxidants, fungicides, viscosity adjusting agents, conductive agents, ultraviolet absorbers, chelating agents, and the like.

The processing liquid may contain a component which causes the aggregation of the pigment contained in the ink. Specifically, for example, when the ink comprises a pigment having an anionic group, the processing liquid may comprise an electrolyte, a cationic compound or the like. An examples of the electrolytes preferred in the invention is a salt in which the cation is selected from: alkaline metal ions such as lithium ions, sodium ions, and potassium ions; and polyvalent metal ions such as aluminum ions, barium ions, calcium ions, copper ions, iron ions, magnesium ions, manganese ions, nickel ions, tin ions, titanium ions, and zinc ions, and in which the anion is selected from hydrochloric acid, hydrobromic acid, hydroiodic acid, sulfuric acid, nitric acid, phosphoric acid, thiocyanic acid, and organic carboxylic acids such as acetic acid, oxalic acid, lactic acid, fumaric acid, citric acid, salicylic acid, and benzoic acid, and organic sulfonic acids.

Specific examples of the electrolyte include: salts of alkaline metals such as lithium chloride, sodium chloride, potassium chloride, sodium bromide, potassium bromide, sodium iodide, potassium iodide, sodium sulfate, potassium nitrate, sodium acetate, potassium oxalate, sodium citrate, and potassium benzoate; and salts of polyvalent metals such as aluminum chloride, aluminum bromide, aluminum sulfate, aluminum nitrate, aluminum sodium sulfate, aluminum potassium sulfate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogen phosphate, calcium thiocyanate, calcium benzoate, calcium acetate, calcium salicylate, calcium tartrate, calcium lactate, calcium fumarate, calcium citrate, copper chloride, copper bromide, copper sulfate, copper nitrate, copper acetate, iron chloride, iron bromide, iron iodide, iron sulfate, iron nitrate, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogen phosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate.

Examples of the cationic compound include primary, secondary, tertiary, and quaternary amines and salts thereof. Specific examples thereof include tetraalkylammonium salts, alkylamine salts, benzalkonium salts, alkylpyridinium salts, imidazolium salts, and polyamines; more specific examples thereof include isopropylamine, isobutylamine, t-butylamine, 2-ethylhexylamine, nonylamine, dipropylamine, diethylamine, trimethylamine, triethylamine, dimethylpropylamine, ethylenediamine, propylenediamine, hexamethylenediamine, diethylenetriamine, tetraethylenepentamine, diethanolamine, diethylethanolamine, triethanolamine, tetramethylammonium chloride, tetraethylammonium bromide, dihydroxyethylstearylamine, 2-heptadecenyl-hydroxyethylimidazoline, lauryldimethylbenzylammonium chloride, cetylpyridinium chloride, stearamidemethylpyridinium chloride, diallyldimethylammonium chloride polymers, diallylamine polymers and monoallylamine polymers.

Preferable examples of the electrolyte include aluminum sulfate, calcium chloride, calcium nitrate, calcium acetate, magnesium chloride, magnesium nitrate, magnesium sulfate, magnesium acetate, tin sulfate, zinc chloride, zinc nitrate, zinc sulfate, zinc acetate, aluminum nitrate, monoallylamine polymers, diallylamine polymers, and diallyldimethylammonium chloride polymers.

The processing liquid may contain an anionic compound or the like when the ink contains a pigment having a cationic group on its surface. Examples of the anionic compound preferred in the invention include organic carboxylic acids, organic sulfonic acids, and salts thereof. Specific examples of the organic carboxylic acids include acetic acid, oxalic acid, lactic acid, fumaric acid, citric acid, salicylic acid, benzoic acid, and oligomers and polymers having a plurality of basic structures selected from the above organic carboxylic acids. Specific examples of the organic sulfonic acids include compounds such as benzenesulfonic acid, toluenesulfonic acid, and oligomers and polymers having a plurality of basic structures selected from the above organic sulfonic acids.

The processing liquid may comprise only one compound capable of causing the aggregation of the pigment contained in the ink or a mixture of two or more compounds capable of causing the aggregation of the pigment contained in the ink. The content of the compound capable of causing the aggregation of the pigment contained in the ink in the processing liquid is preferably 0.1 to 15% by weight, more preferably 0.5 to 10% by weight.

The processing liquid may further comprise a surfactant, similarly to the case of the ink. Examples of the surfactant usable in the processing liquid are the same as the examples described in the explanation of the surfactant usable in the ink.

The inkjet recording apparatus as an example of the droplet ejecting apparatus of the invention may further comprise a maintenance unit which maintains the recording head during non-printing time so as to maintain or recover the ejection property or the like. The maintenance unit generally comprises a cap that collects printing liquids ejected from the recording head by dummy jetting or discharged by suction with a pump or the like, by using its inner surface for receiving the printing liquids.

From the viewpoint of high speed printing, a higher conveyance velocity of the recording medium is preferable. However, an exceedingly fast conveyance leads to large ejection quantity of the recording liquid per unit time, thereby causing easy scattering of the recording liquid. In the inkjet recording apparatus of FWA system described above as an example of the first embodiment, the droplet ejecting face of the recording face has a water-shedding film and a hydrophilic film; therefore, adhesion of ink and hardening of the adhered ink are prevented even when the conveyance velocity of the recording medium is increased. Accordingly, the adhesion of the recording liquid components is suppressed, and the degradation of the image quality and ink clogging are also suppressed even at a high conveyance velocity of the recording medium of 100 mm/s or higher.

From the viewpoint of the improvement of image quality (definition of the image), the liquid quantity per one drop of the printing liquid ejected from the recording head is preferably smaller. However, when the liquid droplets to be ejected are small, the volume change of the droplets at the time of ejection is also small, whereby the meniscus of the recording liquid is easily affected by the adhesion of dirt containing printing liquid components.

In the droplet ejecting apparatus of the first embodiment, the droplet ejecting face of the recording head is provided with a water-shedding film and a hydrophilic film. Accordingly, the recording liquid meniscus is stabilized even when the liquid amount per one drop is reduced. Even when the liquid amount per one drop is in the range of 10 pl or smaller, which is suitable for high-quality image formation, the adhesion of dirt to near the nozzles is suppressed, and the degradation of image quality and ink clogging are suppressed.

As described above, in the above examples of the invention (both of the first and second embodiments), an inkjet recording apparatus utilizing an inkjet system is described. The inkjet system may be, for example, thermal inkjet system, piezoelectric inkjet system, continuous flow inkjet system, or electrostatic attraction inkjet system. Other inkjet systems are also usable.

Also, the inks to be used is not particularly limited, and may be an aqueous ink, an oil-based ink, a so-called solid ink that is solid at room temperature, or a solvent ink. The colorant contained in the ink is not particularly limited, either, and may be a pigment or a dye.

In the above example of the invention (both of the first and second embodiment), an inkjet recording apparatus is used as an example of the droplet ejecting apparatus. However, the application of the invention is not limited thereto, and may be applied to various applications including droplet ejecting apparatuses for direct circuit drawing method of directly forming a circuit pattern on a substrate, droplet ejecting apparatuses for color filter formation, and droplet ejecting apparatuses for the formation of optical elements for plane-emission luminescent elements.

Accordingly, the recording medium to be used in the invention is not limited to recording paper, and may be selected from various recording media including intermediate transfer members, glass substrates, and plastic substrates.

In the production of color filters, for example, ink tanks can be, at any time, supplied with curable optical resins which are colored in specified colors by coloring agents, and the curable optical resins may be selected, for example from ultraviolet-curable epoxy-based optical resins, ultraviolet-curable acrylate optical resins, and various thermally-curable optical resins.

In the production of optical elements for plane-emission luminescent elements, for example, the optical elements are produced by curing liquid materials (such as precursors of ultraviolet-curable resins and thermally-curable resins) which are curable by application of energy such as heat or light. Accordingly, the liquid storage unit stores an ultraviolet-curable acryl-based or epoxy-based resin or a thermally-curable polyimide-based resin as a thermally-curable resin.

EXAMPLES

The present invention will be specifically described with reference to examples hereinafter.

Example 1 and Comparative Example 1

Preparation of Inkjet Recording Liquid Set

Adequate amounts of a coloring agent solution, a water-soluble organic solvent, a surfactant, ion exchange water, and the like are mixed such that a predetermined composition is obtained. The mixture liquid is stirred. The resultant liquid is allowed to pass through a 5 μm filter, whereby each liquid is obtained.

(Inkjet Recording Liquid Set 1)

| Ink 1 (black ink) | |
|---|---|
| CABOJET-300 (having a carboxylic group, manufactured by Cabot Corporation) | 4% by weight |

-continued

| Ink 1 (black ink) | |
|---|---|
| Styrene-acrylic acid copolymer (acid value: 100, neutralization value: 95%) | 1% by weight |
| Diethylene glycol | 15% by weight |
| Thiodiglycol | 2.5% by weight |
| Diethylene glycol monobutyl ether | 2.5% by weight |
| Acetylene glycol ethylene oxide adduct | 0.2% by weight |
| Ion exchange water | Remainder |

| Ink 2 (cyan ink) | |
|---|---|
| C.I. Pigment Blue 15:3 (having a sulfonic group) | 4% by weight |
| Diethylene glycol | 20% by weight |
| Propylene glycol | 2.5% by weight |
| Diethylene glycol monobutyl ether | 2.5% by weight |
| Acetylene glycol ethylene oxide adduct | 1% by weight |
| Furancarboxylic acid | 1% by weight |
| Sodium hydroxide | 0.2% by weight |
| Ion exchange water | Remainder |

| Ink 3 (magenta ink) | |
|---|---|
| C.I. Pigment Red 122 (pigment having a sulfonic group) | 4% by weight |
| Diethylene glycol | 15% by weight |
| Triethylene glycol | 5% by weight |
| Sulfolane | 2.5% by weight |
| Diethylene glycol monobutyl ether | 2.5% by weight |
| Acetylene glycol ethylene oxide adduct | 1% by weight |
| Ion exchange water | Remainder |

| Ink 4 (yellow ink) | |
|---|---|
| C.I. Pigment Yellow 128 (pigment having a sulfonic group) | 4% by weight |
| Diethylene glycol | 20% by weight |
| Diethylene glycol monobutyl ether | 5% by weight |
| Acetylene glycol ethylene oxide adduct | 1% by weight |
| Ion exchange water | Remainder |
| **Processing liquid** | |
| Diethylene glycol | 25% by weight |
| Magnesium nitrate hexahydrate | 5% by weight |
| Acetylene glycol ethylene oxide adduct | 1% by weight |
| Ion exchange water | Remainder |

<Production of Recording Head>

(Recording Head A)

On the nozzle face (15 mm×225 mm) of a recording head of 600 dpi and 4960 nozzles, a titanium oxide film having a thickness of 5 μm is formed by the method shown in FIGS. 3A to 3F. The titanium oxide film is a hydrophilic film and has an original water contact angle of 40 to 50 degrees and a water contact angle of 3 to 10 degrees after ultraviolet irradiation. On the titanium oxide film, a water-shedding film is formed. The material of the water-shedding film is transparent fluororesin, and the water-shedding film has a size of 0.2 mm×215 mm and a water contact angle of 100 to 110 degrees. The thickness of the water-shedding film is selected from 0.5 μm, 1 μm, 5 μm, 10 μm, and 20 μm. Thereafter, a nozzle having a diameter of 30 μm is formed in the centre of the water-shedding film, whereby six recording heads A which are respectively different in the thickness of the water-shedding film are obtained.

(Recording Head B)

A recording head B is produced in the same manner as the production of the recording head A except that a silane coupling agent film (having a water contact angle of 10 to 20 degrees) having a thickness of 5 μm is used as the hydrophilic film, instead of the titanium oxide film, and except that the thickness of the water-shedding film is 5 μm.

<Droplet Ejecting Condition>

Ejection is conducted, using a thermal inkjet apparatus for evaluation shown in FIG. 1 equipped with a full-line head containing five heads for respective colors each having a nozzle face having 600 dpi and 4960 nozzles as a recording head. Inks 1 to 4 and the processing liquid are placed in the respective heads in this order.

The recording head is further provided with a maintenance unit comprising a cap for capping the nozzles and a rubber wiper blade, and the maintenance unit further comprises a black light as a ultraviolet irradiation device such that the ink ejecting face can be irradiated with the ultraviolet light emitted from the black light at irradiation light intensity of about 1 $mJ/cm^2 \cdot s$, as shown in FIG. 4B, and such that the ultraviolet irradiation is conducted only during non-printing long standby periods.

MULTI ACE paper manufactured by Fuji Xerox Office Supply and the like are used as recording media. The amount of ejection is set at about 10 pl, the amount of ink deposition is set at about 0.03 $ml/m^2$, the weight ratio of the processing liquid to the ink (processing liquid/ink) at ejection is set at ½, the sheet conveying speed is set at 105 mm/sec, and the image to be recorded is an A4 pattern with 5% coverage for each color. The ejection is conducted under a standard condition (temperature: 23±0.5° C., humidity: 55±5% RH).

Under the ejection condition, each ejection test is conducted at a driving frequency of 9 kHz until the cumulative dot number reaches $10^8$. In Example 1, recording head A is used. In Comparative Example 1, recording head B is used. Wiping is conducted every $10^5$ dots. The following evaluations are conducted at the initial state (before start of the ejection test) and at the time ejection has been conducted on $10^8$ dots.

(Deviation of Deposition Point)

The dots of the image formed by the ejection are observed under a microscope, and the deviation of the deposition point is measured and evaluated according to the following criteria:

A the deviation of the deposition point is smaller than 20 μm;

B the deviation of the deposition point is 20 μm or larger but smaller than 40 μm;

C the deviation of the deposition point is 40 μm or larger.

(Presence or Absence of Dirt Around Nozzles)

After the ejection on $10^8$ dots, presence or absence of adhered dirt around the nozzles is confirmed with the naked eye. Then, the ejection is further conducted and the effects of the dirt on the image quality are observed and evaluated according to the following criteria:

A there is no adhered dirt;

B a little adhered dirt is observable, but the image quality is not affected;

C adhered dirt is observable and image degradation (streak-like unprinted region) is confirmed.

The results are shown in Table 1

TABLE 1

| | Thickness of Water-shedding Film (μm) | Deviation of Deposition Point | | Presence or Absence of Adhered Dirt |
|---|---|---|---|---|
| | | Initial | After $10^8$ dots | |
| Example 1 | 0.5 | A | B | B |
| | 1 | A | A | A |
| | 5 | A | A | A |
| | 10 | A | A | A |
| | 20 | B | A | A |
| Comp. Ex. 1 | 5 | A | C | C |

As is clear from Table 1, the inkjet recording apparatus as an example of the droplet ejecting apparatus (and the method of cleaning the droplet ejecting face) according to the first embodiment can realize the stable formation of high-quality image over long time without adhesion of recording liquid components to the recording head even when the droplet ejection is conducted by FWA system. In contrast, the comparative inkjet recording apparatus having no photocatalyst on the droplet ejecting face clearly has problems caused by the adhesion of dirt onto the ejecting face.

Example 2

In order to determine the minimum required thickness of the titanium oxide film, an evaluation test is conducted under the following conditions.

Printing is conducted using an inkjet recording apparatus equipped with an experimental recording head having 256 nozzles capable of ink ejection at 400 dpi with the driving frequency of the piezoelectric element of the recording head set at 9 kHz. Every time printing on 25 sheets P is completed, cleaning device 140 is operated, blade 142 wipes nozzle face 120A of recording head 120, and wiping part 172 of wiping member 170 wipes off the ink adhered to blade 142.

Figure 9:
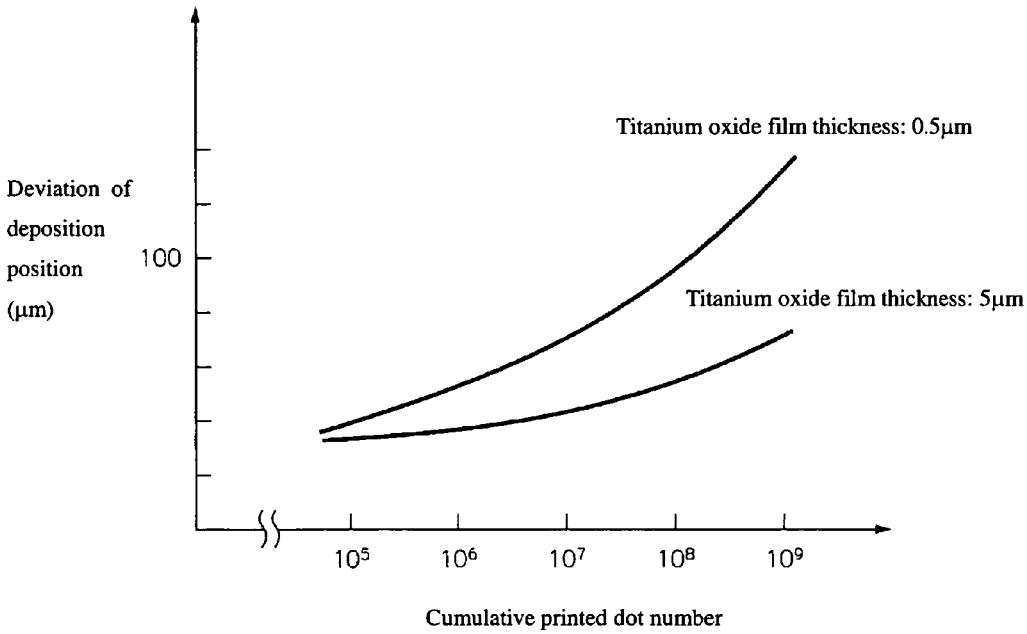
FIG. 9 is a graph showing the relationship between the cumulative printed dots per one nozzle of the recording head and the deviation of the deposition point, on a sheet P, of the ink.

The graph of FIG. 9 shows the relationship between cumulative printed dots per one nozzle and deviation of the ink deposition point on sheet P in each of the cases of titanium coatings respectively with thicknesses of 0.5 μm and 5 μm provided on wiping part 172 of wiping member 170.

Sensory evaluation is conducted every time the cumulative printed dots reach any of the specified numbers at printing of JEDIA Standard Pattern J6 Chart (which is incorporated herein by reference), and the results are shown in Table 2.

The evaluation criteria are as follows:

A: No defect is observable;

B: Slight streak-like unprinted regions are observable;

C: A lot of streak-like unprinted regions are observable and the printed image is practically unacceptable.

TABLE 2

| | | Cumulative printed dot number | | | |
|---|---|---|---|---|---|
| | | $10^6$ | $10^7$ | $10^8$ | $10^9$ |
| Thickness of titanium oxide film (μm) | 0.5 | A | B | C | C |

As is clear from the graph of FIG. 9 and Table 2, when the thickness of the titanium oxide film is 0.5 μm and the cumulative printed dot number exceeds $10^8$, the deviation of ink deposition point becomes large and many streak-like unprinted regions occur. In contrast, with a titanium oxide film thickness of 5 μm, the deviation of ink deposition point is sufficiently small for maintaining the image quality and streak-like unprinted regions hardly occur, even when the cumulative printed dot number exceeds $10^8$. Accordingly, it is found that the degradation of image quality is apparent when the thickness of the titanium oxide film is 0.5 μm while the degradation of image quality does not occur when the thickness of the titanium oxide film is 5 μm.

Table 3 shows the state of the ink ejection directivity and presence or absence of adhered ink near the nozzles at various titanium oxide film thicknesses.

TABLE 3

| | Titanium oxide film thickness (μm) | | | | |
|---|---|---|---|---|---|
| | 0.1 | 0.5 | 1 | 5 | 10 |
| Directivity (initial) | Fine | Fine | Fine | Fine | Fine |
| Directivity (after ejection to $10^8$ dots) | Defective | Defective | Slightly defective | Fine | Fine |
| Presence or absence of adhered ink around the nozzles | Observable | Observable | Observable only slightly | Not observable | Not observable |

As is clear from Table 3, when the thickness of the titanium oxide film is 1 μm or larger, adhered ink does not remain near the nozzles and the ink ejection directivity is stabilized. In contrast, when the thickness of the titanium oxide film is smaller than 1 μm, adhered ink remains near the nozzles. This is supposedly because titanium oxide coated on wiping part 172 is abraded by the sliding contact with blade 142 owing to the insufficient thickness of the titanium oxide film, thereby lowering the ink decomposition performance. Further, the ink adhered to near the nozzles destabilize the ink ejection direction. Accordingly, it is preferable to set the thickness of the titanium oxide film to be coated on wiping part 172 of wiping member 170 at a thickness which is not smaller than 1 μm because the titanium oxide film having such a thickness realizes the formation of good images without degradation of image quality.

In the Examples, full-line head inkjet recording apparatuses are described. However, the invention is not limited thereto, and may be applied to serial-type inkjet recording apparatuses having a recording head which can reciprocate.

As described above, the present invention provides a droplet ejecting apparatus which can eject droplets stably for a long period while preventing the deposition of solid matter near the nozzles provided on the droplet ejecting face or making the deposition easily removable particularly when the droplet ejection quantity is large. The invention also provides a method of cleaning the droplet ejecting face. The invention further enables stabilization of the directivity of the ejection of ink droplet by the removal of the dirt adhered to the nozzles by completely wiping the dirt adhered to the blade.

I claim:

1. A droplet ejecting apparatus comprising:

a droplet ejecting unit having a droplet ejecting face that is provided with nozzles which eject droplets containing an organic compound;

a water-shedding film provided on the droplet ejecting face in an area near the nozzles; and a hydrophilic film containing a photocatalyst in a region on the droplet ejecting face other than near the area having the water-shedding film, wherein the droplet ejecting apparatus ejects the droplets by an inkjet method.

2. The droplet ejecting apparatus according to claim 1, wherein the photocatalyst is titanium oxide.

3. The droplet ejecting apparatus according to claim 1, further comprising an ultraviolet irradiation unit which irradiates the droplet ejecting face with ultraviolet rays.

4. The droplet ejecting apparatus according to claim 1, wherein the ejection of droplets from the nozzles is conducted by displacement of a piezoelectric element.

5. The droplet ejecting apparatus according to claim 1, wherein the droplet ejecting unit has nozzles along the entire width of a region to be recorded.

6. The droplet ejecting apparatus according to claim 1, wherein the droplets comprise a resin.

7. The droplet ejecting apparatus according to claim 1, wherein the droplet ejecting unit is a recording head which ejects droplets of a recording liquid containing an organic compound from nozzles upon application of a driving signal based on image data, and which records an image on a recording medium by ejection of the droplets from the droplet ejecting face of the recording head.

8. The droplet ejecting apparatus according to claim 7, wherein the recording head has nozzles along the entire width of a region to be recorded.

9. The droplet ejecting apparatus according to claim 7, wherein the recording liquid contains a resin.

10. The droplet ejecting apparatus according to claim 1, wherein the hydrophilic film has a thickness in the range of 2 to 8 μm.

11. A method for cleaning a droplet ejecting face of a droplet ejecting unit, wherein the droplet ejecting face is provided with nozzles which eject droplets containing an organic compound, the method comprising:

providing a water-shedding film in an area near the nozzles on the droplet ejecting face;

providing a hydrophilic film containing a photocatalyst at a region on the droplet ejecting face other than the area having the water-shedding film; and irradiating the droplet ejecting face with ultraviolet rays to remove dirt adhered to the droplet ejecting face.

12. The method for cleaning a droplet ejecting face of a droplet ejecting unit according to claim 11, wherein the hydrophilic film has a thickness in the range of 2 to 8 μm.

* * * * *